United States Patent [19]

Reed

[11] 3,985,003

[45] Oct. 12, 1976

[54] PRESEAMED AND PREFORMED KNITTED GARMENTS AND METHOD OF MAKING SAME

[75] Inventor: Alfred J. Reed, Greensboro, N.C.

[73] Assignee: J. P. Stevens & Co., Inc., New York, N.Y.

[22] Filed: May 1, 1975

[21] Appl. No.: 573,550

[52] U.S. Cl. ..... 66/196; 66/171; 66/177; 66/176

[51] Int. Cl.[2] ..... D04B 7/04

[58] Field of Search ..... 66/17, 19, 21, 22, 169, 66/170, 171, 172, 173, 174, 175, 176, 177, 196

[56] References Cited

UNITED STATES PATENTS

| | | | |
|---|---|---|---|
| 473,474 | 4/1892 | Pepper | 66/173 |
| 709,734 | 9/1902 | Bellis | 66/196 |
| 872,163 | 11/1907 | Williams | 66/196 |
| 2,879,654 | 3/1959 | Evans | 66/196 X |
| 2,921,456 | 1/1960 | Evans | 66/196 X |
| 3,307,379 | 3/1967 | Woolley | 66/196 X |

FOREIGN PATENTS OR APPLICATIONS

| | | | |
|---|---|---|---|
| 1,003,382 | 9/1965 | United Kingdom | 66/171 |

*Primary Examiner*—Ronald Feldbaum
*Attorney, Agent, or Firm*—Leitner, Palan & Martin

[57] ABSTRACT

A knitted structure and method of making same which includes simultaneously knitting two concentric tubes and interconnecting the tubes by knitting to produce seams which define a garment of juxtaposed portions of the two tubes. Each concentric tube includes a plurality of feeds per course knitted separately on the dial and cylinder needles, respectively, of a circular knitting machine.

16 Claims, 12 Drawing Figures

PRESEAMED AND PREFORMED KNITTED GARMENTS AND METHOD OF MAKING SAME

BACKGROUND OF THE INVENTION

1. Field of the Invention

The present invention relates generally to knitted garments and more particularly to a garment which is preseamed and preformed on a circular knitting machine.

2. Description of the Prior Art

Clothing in the garment industry is generally made by superimposing one fabric over another, cutting it into panels to conform to the shape of the individual according to current fashion, seaming along the outer edges of the panel and attaching various parts, by stitching to form seams, until a complete garment is formed.

In the knitting industry, a limited class of open-ended, tubular garments (for example, foundation garments such as girdles, panties, etc.) and those utilizing elastic or spandex types of yarn, have been formed on a warp knit Raschel-type machine. Garments made on this machine are made so that the wale direction of the fabric is horizontal to the ground or is worn 90° from the direction in which it was knit. The warp knit Raschel-type machine has limited pattern scope (width approximately 20 inches) and, therefore, is not acceptable for all types or sizes of garments. An example of this type of garment is found in U.S. Pat. No. 3,656,323.

Circular knitting machines have been used to make tubular, knitted garments, such as ladies' stockings, sweaters and other garments. In these tubular garments, the user's anatomy is in the center of the single tube. "Two tube," "double layer," "Bi-knit" and "duo-fold" fabrics have been produced on circular knitting machines. These fabrics involve two layers interconnected at points for their artistic properties (ottoman or Ponte De Roma patterns), thermal properties (U.S. Pat. No. 2,921,457) and armor piercing qualities (U.S. Pat. No. 2,879,654). The fabric itself is used as a unit to form one surface of a finished garment.

When the computer began to be used as pattern preparation equipment for electronic double knit machines in the early 1970's, an era of unlimited pattern potential began. Heretofore, with mechanical type pattern machines, maximum pattern widths were approximately 144 wales wide, 324 courses high. Computer electronic knitting brought about the possibilities of making patterns and designs of up to three million stitches (previously approximately 50,000 was maximum). With this system, patterns and designs are possible that before could not be made.

SUMMARY OF THE INVENTION

The present invention uses an electronic circular double knitting machine programmed to simultaneously knit two concentric tubes, one on the dial set of needles and a second on the cylinder set of needles and additionally programmed to interconnect the two concentric tubes by a knit interlock stitch to form the outline of the design of a garment. The resulting knitted structure will have two layers of single fabric knitted or seamed together in the shape of the desired garment wherein the anatomy of the user would fit between the single knitted fabrics instead of in the center of the tubes. The final garment has a first surface formed from portions of one tube and a second surface formed from a juxtaposed portion of the other tube. By aligning the longitudinal axis of the garment parallel to the axis of the tube, a plurality of garments may be formed about a circumference of the concentric tubes. By varying the height of knitting butts of alternate knitting dial needles, the inner-concentric tube is knitted in a non-ladder knit. The dial set of needles may knit a different pattern than the cylinder set of needles using different fabrics so as to form, for example, a section of a garment on the cylinder needle and forming the lining or interfacing for that section of garment on the dial needles. The garment formed around the circumference of the tube is severed by cutting from the tube and turned inside out if a hidden seam is desired.

OBJECTS OF THE INVENTION

An object of the present invention is to provide a method for preseaming and preforming knitted garments.

Another object of the present invention is to provide a method of reducing the cost of manufacturing of garments by using the versatility of a computerized electronic knitting machine.

A further object of the invention is to produce a weft knitted garment preseamed and preformed on a circular knitting machine.

Still another object is to provide a method for producing a plurality of garments formed about the circumference of a knitted tube.

An even further object is to provide a knitted structure where a garment is formed from two juxtaposed sections of a tube so that the anatomy of the user fits between the single juxtaposed layers.

Other objects, advantages and novel features of the present invention will become apparent from the following detailed description of the invention when considered in conjunction with the accompanying drawings.

BRIEF DESCRIPTION OF THE PREFERRED EMBODIMENTS

Figure 1:
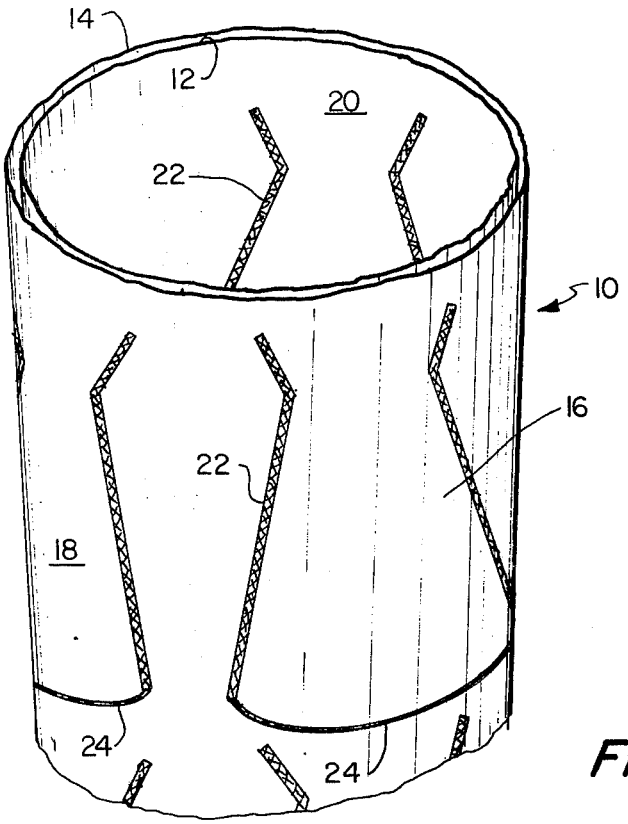
FIG. 1 is a perspective view of a tube of a preferred embodiment of the knitted structure of the present invention as it would come off a circular knitting machine.

FIG. 1 illustrates a knitted structure 10 which is a preferred embodiment of the present invention as it would come off a circular double knit knitting machine. The knitted structure 10 comprises an inner tube 12 and an outer tube 14 which is concentric to, and encompasses, the inner tube 12. The tubes 12 and 14 are simultaneously knitted concentrically on a circular double knit machine. Around the circumference of the knitted structure 10 are illustrated three garments which, for example, may be skirts 16, 18 and 20.

The garments 16, 18 and 20 are outlined by a plurality of interconnecting knitted stitches 22 and 24. The interconnecting knitting 22 not only forms the outline of the garments 16, 18 and 20, but joins the inner tube 12 to the outer tube 14 so as to create a seam. The interconnecting knitting 24 is merely to define the lower outline of the skirt upon which the pattern may be cut. As can be seen, the knitted structure 10 includes (around its circumference) a plurality of finished garments which need only be severed from the structure 10 and turned inside out if a hidden seam is desired. Only a minimum amount of additional sewing is required to form hems and attach various decorative ornaments to complete a finished garment.

It should be noted that the garments formed on the knitted structure 10 have a first surface on inner tube 12 and a second surface on a juxtaposed portion of outer tube 14. The anatomy of the user is inserted between the two portions of tubes 12 and 14. This is different from the prior art wherein the garment would be the knitted structure 10 itself and the anatomy of the user would be inserted interior to the tubing of the knitted structure 10 having a double layer 12 and 14 external to the anatomy of the wearer. It is obvious from viewing FIG. 1 that a longitudinal axis of the garments 16, 18 and 20 is parallel to the axis of the knitted structure 10 and consequently the axis of tubes 12 and 14.

It should be noted that circular "double knit machine" refers to a machine that has two separate sets of needles (cylinder and dial) that operates at approximately 90° from each other and is capable of pulling a stitch in a continuous manner either independent of each other or in conjunction with each other. The most common method of making two tube fabric is by alternating feeds method. That is, by utilizing the odd numbered feeds for the cylinder (outer tube fabric) and the even numbered feeders for the dial (inner fabric tube).

This method, of course, could be reversed and, with proper setting of the cylinder and dial cams, the odd numbered feeds could made the dial or inner layer of fabric and the even numbered feeders could make the cylinder or outer layer of the fabric. Two tube fabric can be made in a number of ways and with a variety of different stitches. For the most part, the outer and the inner fabrics should have the same type of stitch. This is desirable in some cases, but not in all. The basic prerequisite for two tube fabric is balance of stitch length or run-in so that the two tubes of fabric can be pulled down by a common take-up from the needles. An example of a circular knitting machine which will produce knitted structure 10 is Model 9RJ36 made by Wildt, Mellor, Bromley, Ltd. of Leicester, England.

If the two tubes 12 and 14 are knitted of two different fibers, the knitted structure may form sections of a garment to be assembled in the regular manner. For example, the outside tube 14 may be a normal decorative fabric wherein the inner tube 12 may be formed of material such as lining. By simultaneously knitting and interknitting the two layers, a step is saved by producing a section of garment which is prelined. Similarly, the layer 12 (instead of being lining) may be interfacing, which is attached to the outside layer 14 and again saves a step in the manufacture of garments. Another example where two different fibers are used to make the inner and outer tubing would be in the foundation garment industry, where the inner fabric could be cotton or other soft fibers and the outer fabric would be lycra or elasticized yarns.

Figure 2A:
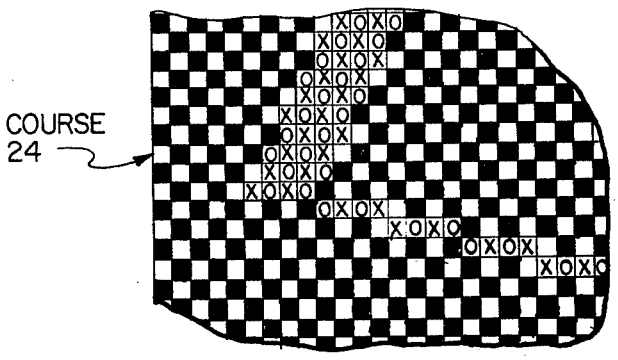
FIG. 2A is an exploded view of a portion of FIG. 2.
Figure 2:
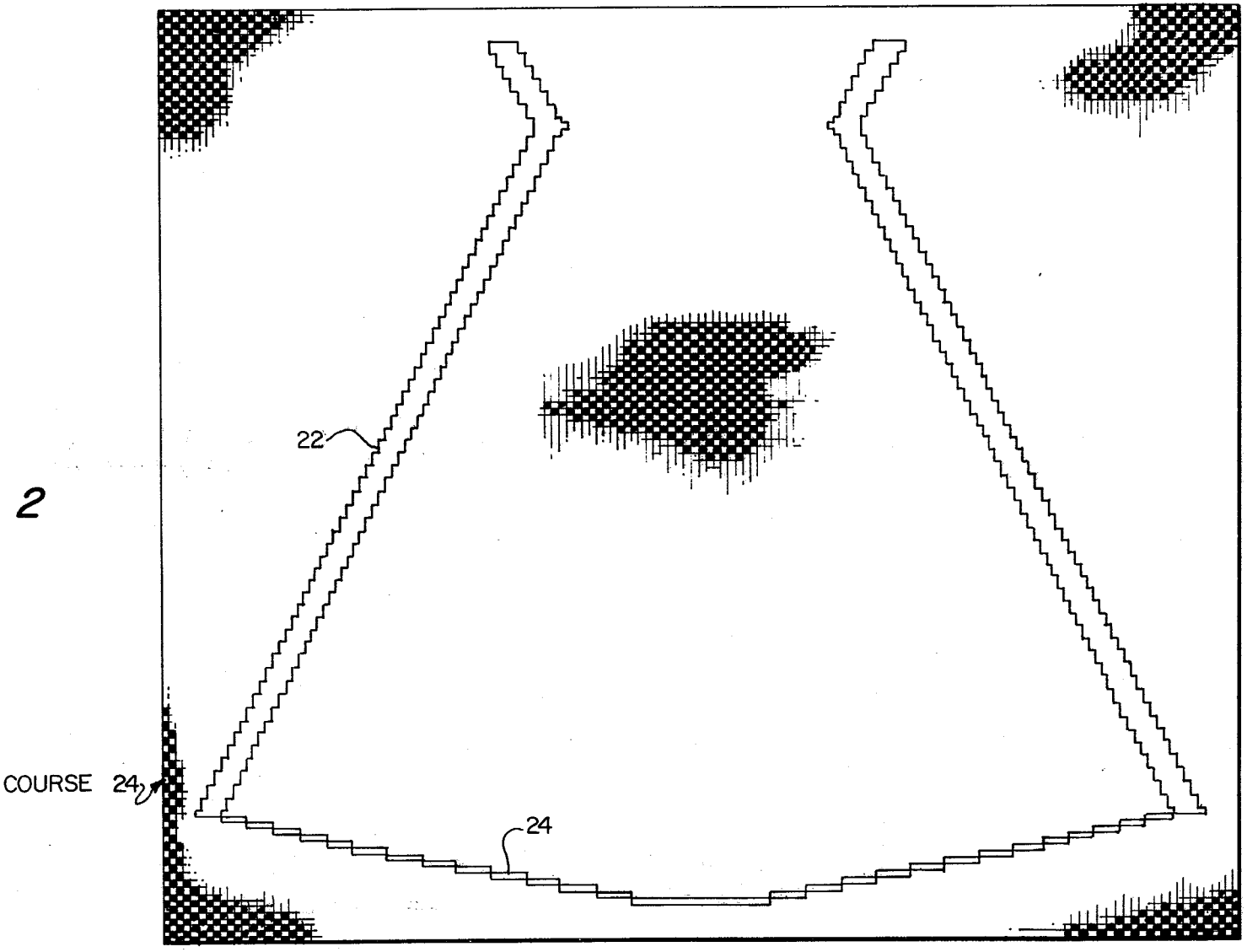
FIG. 2 is a pattern graph of a skirt to be formed according to the preferred embodiment of the present invention.

To better understand the knitted structure and method of the present invention, a pattern graph of the garment 16 is illustrated in FIG. 2. The pattern to be mapped out is on graph paper wherein each square represents a knitted stitch. In a preferred embodiment of the subject invention, two feeds are used per course on the cylinder needle and two feeds are used per course on the dial needles. To distinguish the feeds in enlarged detail of FIG. 2A, the notation of a filled-in square will represent one feed and a blank square will represent the second feed per feed pair. To distinguish the stitches which are knitted to form the tubes 12 and 14 from the stitches used to interconnect the tubes 12 and 14, an X and a O are used to represent the interknitted stitches of the feed pair.

In the preferred embodiment, the cylinder set of needles are programmed to effect the interconnecting knitted stitches since they have an infinite degree of control of latitude of stitches. The dial needles are programmed to alternate between short and long heights so as to effect a non-ladder knit pattern or non-run pattern. It should be noted that the interconnecting stitches may be formed by the dial needles instead of the cylinder needles, if desired. Also, FIG. 2 represents generally the stitches formed by the cylinder needles with the stitches formed by the dial needles appearing only as alternate solid and blank squares since the dial needles in the present embodiment do not form any interconnected knitted stitches.

The examination of FIG. 2A reveals that the interknitted stitches which form seam 22 involve two pairs or sets of X's and O's offset in the wale axes by one stitch. The outline seam 24 is formed from two sets of X's and O's which are offset in the wale axes by four wales. The degree of wale offset to form the desired outline is a matter of design and thus not critical. By weft knitting on a double knit circular knitting machine, the adult garments (which could be as wide as 500 wales and as long as 500 courses) can be programmed and produced according to the present invention. One program which would produce the pattern shown in FIG. 2A would be as follows:

| | Non-Interconnect | | Interconnect | |
|---|---|---|---|---|
| | Dial | Cylinder | Dial | Cylinder |
| Feed 1 | Short | ▩ | Short | X |
| Feed 2 | | | | |
| Feed 3 | Long | □ | Long | O |
| Feed 4 | | | | |

Thus four feeds are used to produce one course of the knitted structure 10 or two feeds are used for one course of the inner-tube 12 and two feeds are used for the outer tube 14. The sequence for feeds 1, 2, 3 and 4 is repeated for the thirty-six feeds generally provided. In actual applications, feeds 9, 18, 27 and 36 are out of operation. Thus, one revolution of the machine will produce eight courses of pattern. Using a computerized electronic knitting machine, the specific pattern is easily programmed.

The knitted structure of course 24 of FIG. 2 formed by program 1 is illustrated in FIGS. 3A-3E. The inner knitting fabric formed on the dial needles are shown in FIG. 3A above the outer knitted fabric formed on the cylinder needles. Feed 1 (FIG. 3B) knits on dial needles 2, 4, 6, 8, 12, 14, etc. to form alternate stitches on the inner tube with feed 3 (FIG. 3D) on dial needles 1, 3, 5, 7, 9, 11, 13, 15, etc. stitches therebetween. The outer fabric is formed basically from an alternation of the cylinder needles using feeds 2 and 4 (FIGS. 3C and 3E, respectively). Interknitted stitches (shown as X's and O's in FIG. 2) are formed by feeds 1 and 3 on needles 7 and 9 and 8 and 10, respectively, as shown in FIGS. 3B and 3D. As can be seen in FIG. 3A, feeds 1 and 3 form part of the outer fabric at interconnecting stitches 7, 8, 9, and 10 of course 24 of FIG. 2.

Figure 3:
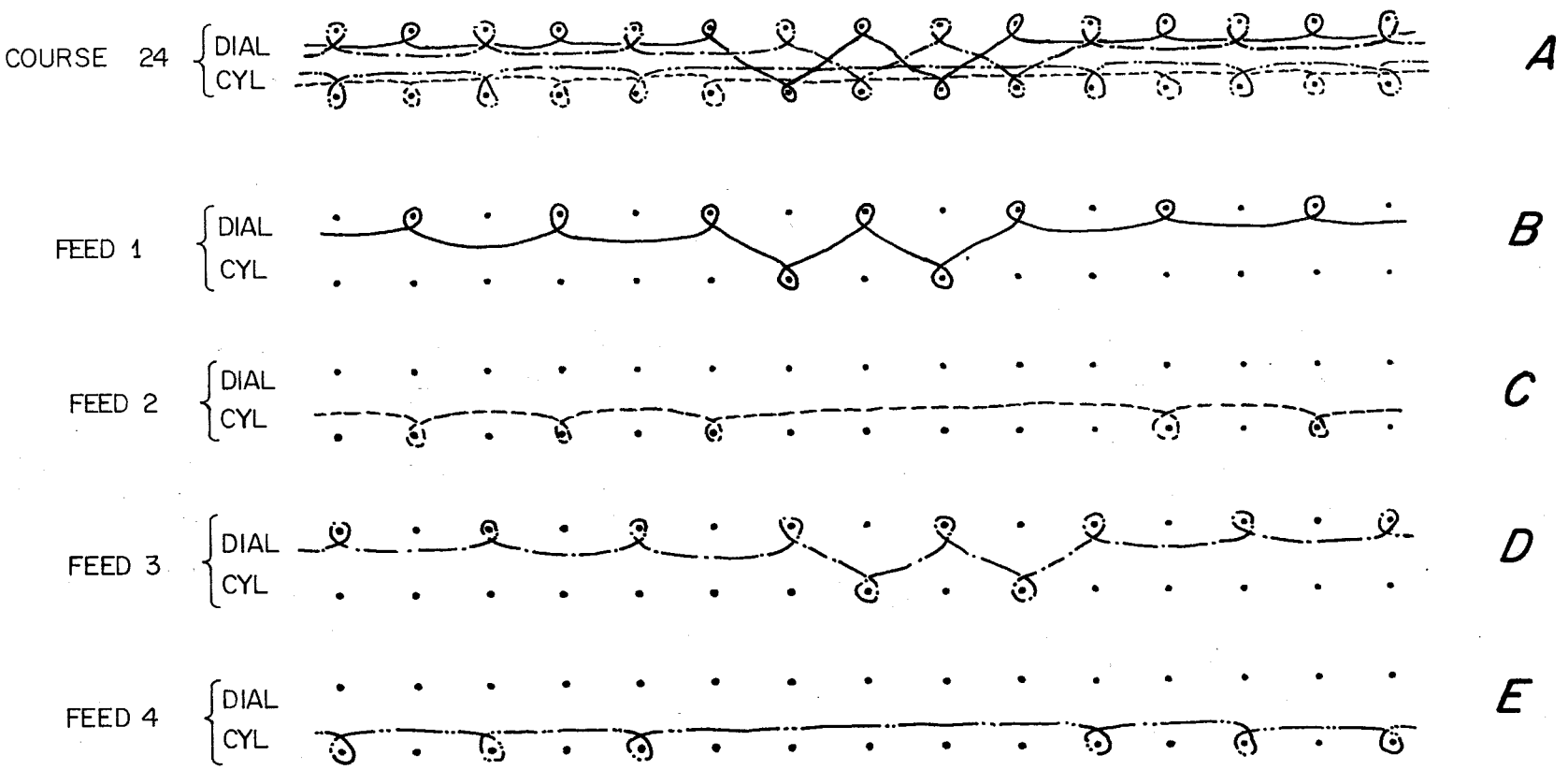
FIGS. 3A–3E are schematics of the knitted structure for a course.

It should be noted that FIG. 3 is a schematic for program 1 to produce course 24 of FIG. 2. If a different program is used or if a different number of interconnected knitted stitches are used (for example, 3 or 2), the schematic of FIGS. 3A-3E would be different, though the general scheme of the pattern would be the same.

A second program which may be used with the method of the present invention is as follows:

| | Non-Interconnect | | Interconnect | |
|---|---|---|---|---|
| | Dial | Cylinder | Dial | Cylinder |
| Feed 1 | Short | ■ | Short | X |
| Feed 2 | | | | X |
| Feed 3 | Long | □ | Long | O |
| Feed 4 | | | | O |

It should be noted that these are merely two examples of the type of program which can be used to form a garment by simultaneously knitting two concentric tubes on two different sets of needles and interconnecting using one of said sets of needles to form a preformed and preseamed garment. To summarize the above two programs, feeds 1 and 3 are used to make the dial fabric 12 and feeds 2 and 4 are used to make the cylinder fabric 14. Cylinder needles are used to interconnect the cylinder fabric with the dial fabric by interknitting at feeds 1 and 3.

Figure 4:
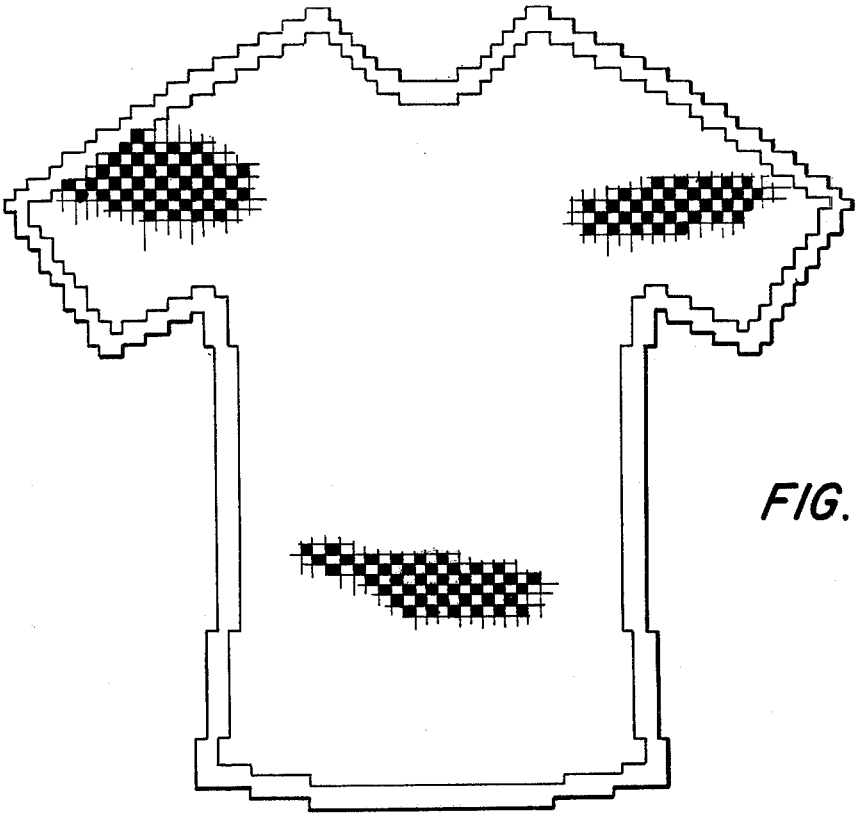
FIG. 4 is a pattern graph of a shirt or blouse to be formed according to a preferred embodiment of the present invention.
Figure 5:
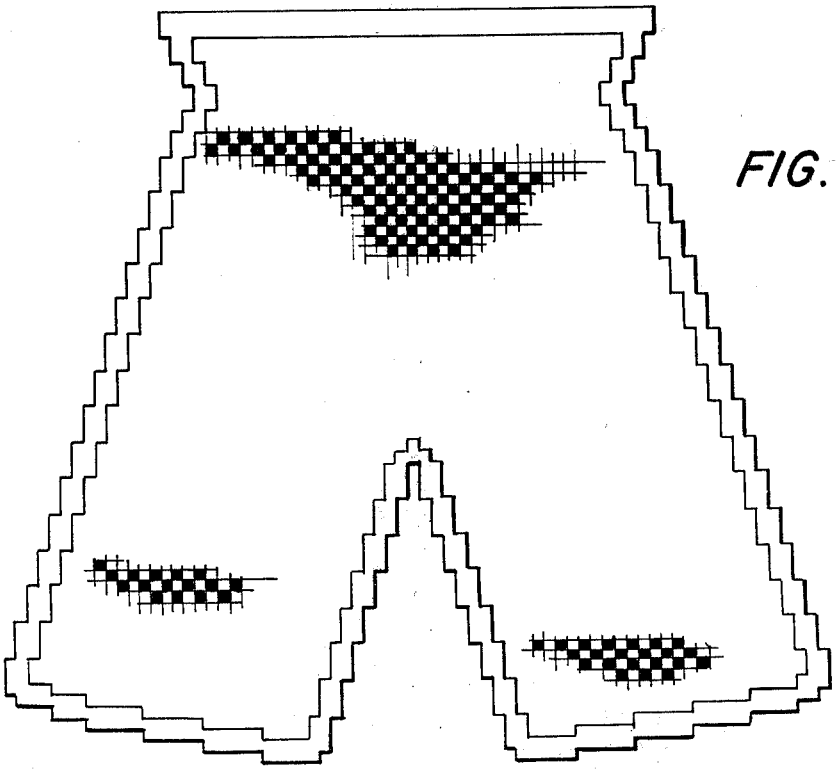
FIG. 5 is a pattern graph of a pair of shorts to be formed according to a preferred embodiment of the present invention.
Figure 4A:
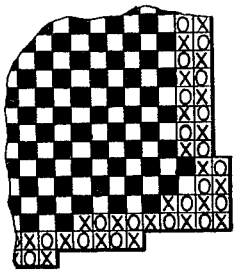
FIG. 4A is an enlarged detailed portion of FIG. 4.
Figure 6:
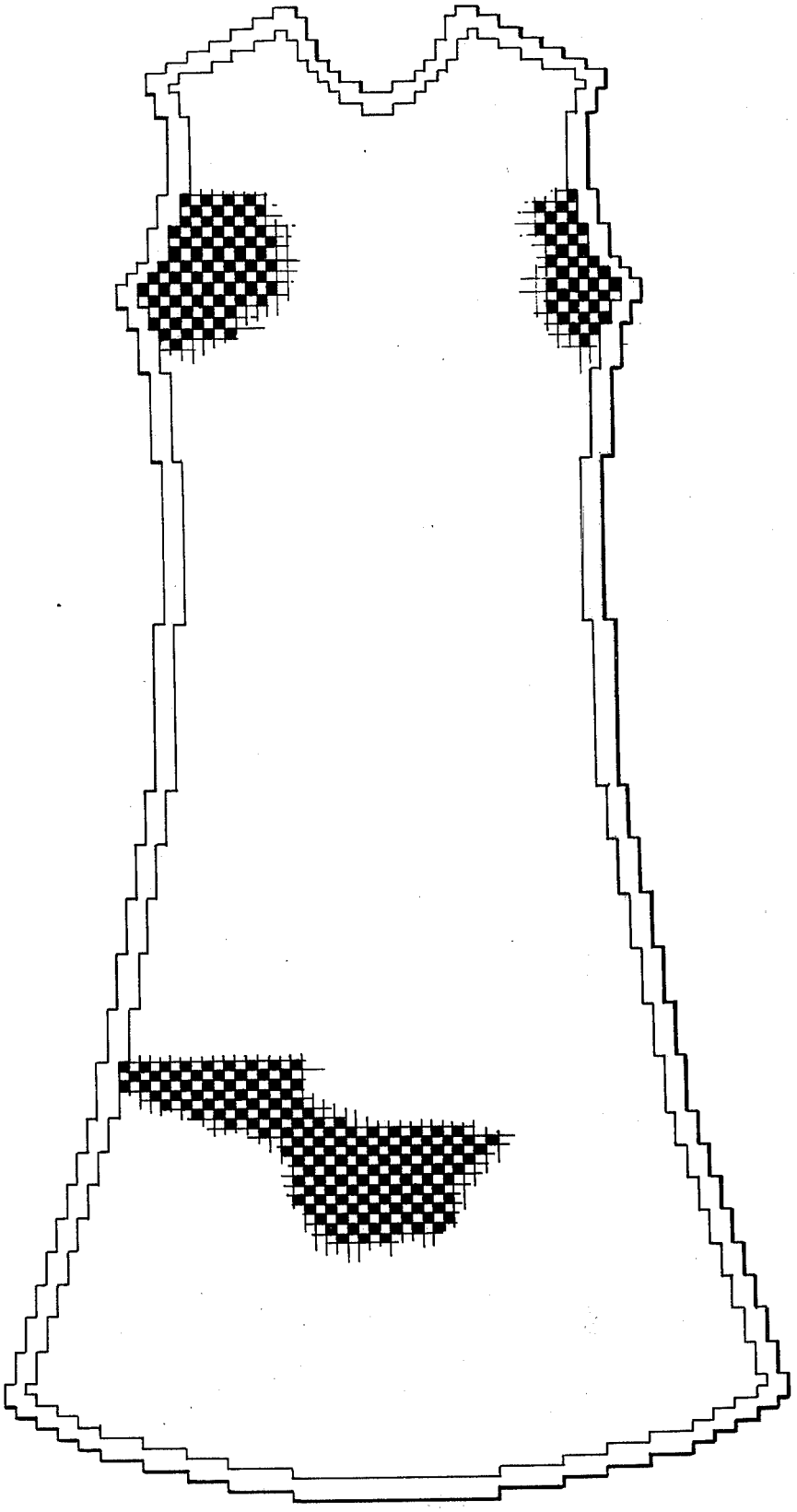
FIG. 6 is a pattern graph of a dress to be formed according to a preferred embodiment of the present invention.

Other types of garment blanks (for example, a blouse or top, a pair of shorts, or a full length dress), may be formed as illustrated in FIGS. 4, 5 and 6, respectively. It should be noted that in the enlarged detail of FIG. 4A only a pair of set of X's and O's are used for the seams, as well as a different pattern of wale offset per course. This illustrates a degree of versatility of the present method as well as the freedom of design that is possible. The present invention may be used to form all types of garments worn by men, women and children - including underwear, outerwear and even full-fashion hosiery. Garments may be not only limited to humans. For example, doll clothing and different size tube widths for industrial purposes may be effectively produced by the present invention. It should also be noted that by the use of "selected" needle knitting and control of stitch length, a degree of fashioning (that is, adding stitches where additional lift, fullness or bulk is required) can be achieved.

As indicated previously, once the knitted structure 10 is removed from the knitting machine, the individual garments may be servered by cutting along the outline formed by the interconnecting stitches represented by the X's and O's. If desired, the fabric may be cut with a hot knife so that the edges are fused together to add additional strength to the seams. Elastic bands may be put in the waist of pants, shorts or skirts and the length adjusted by hemming the lower end. After the product has been finished, it may be inverted to hide the seams, as is well known in the garment industry.

If the present process is used to preform an exterior decorative fabric having a lining or inner-lining or interfacing attached thereto, the severed sections must be assembled and seamed by standard practices. By providing the lining or interfacing already attached to the section, a substantial amount of time is saved in measuring, marking and cutting the original fabric and lining or interlining as well as stitching them together.

From the preceding description of the preferred embodiments, it is evident that the objects of the invention are obtained to produce a preformed and preseamed fabric on a circular knitting machine so as to reduce time, cost and labor involved in making garments. The types of program used to form the final product is to be varied with the imagination of the programmer, as well as the type of product which may be formed. The essence of the present invention is a garment formed of juxtaposed sections of simultaneously knitted, concentric tubes interconnected by knitting. Although the invention has been described and illustrated in detail, it is clearly understood that the same is by way of illustration and example only. The spirit and scope of this invention are limited only by the terms of the appended claims.

What is claimed is:

1. A knitted structure comprising two concentric tubes simultaneously knitted concentrically with said tubes interconnected by knitting at specified regions to define a plurality of garment configurations between said concentric tubes, each of said garment configurations having a first surface on one of said tubes and a second surface on a juxtaposed portion of the other tube with said interconnected knitting forming the stitches connecting said concentric tubes into said garment configurations.

2. The knitted structure of claim 1 wherein said garment configuration has a longitudinal axis and said axis is parallel to the axis of said tubes.

3. The knitted structure of claim 1 wherein said concentric tubes are weft knitted.

4. The knitted structure of claim 1 wherein the interior concentric tube is knitted in a non-ladder knit.

5. The knitted structure of claim 1 wherein each course of each tube is produced from two feeds.

6. A knitted structure comprising a first and second concentric tube simultaneously knitted concentrically and interconnected by knitting at specific regions, said first tube being of a different material than the material of said second tube, said interconnected knitting being connecting stitches and defining a plurality of garment sections spaced along the circumference of the tubes with each garment section having a first surface on said first tube and a second surface on a juxtaposed portion of said second tube with said connecting stitches also constituting guidelines for cutting said sections from said tubes.

7. The knitted structure of claim 6 wherein said first tube is the exterior layer of a garment section and said second tube is the lining layer of said garment section.

8. The knitted structure of claim 6 wherein said first tube is the exterior layer of a garment section and said second tube is the interfacing layer of said garment section.

9. A process for forming a garment configuration defined by juxtaposed portions of two concentric tubes on a circular knitting machine having dial and cylinder sets of needles comprising the steps of:

knitting a first tube on said dial needles only;

simultaneously knitting a second tube on said cylinder needles only concentric to and encompassing said first tube; and interconnecting said first and second tubes by knitting using one of said sets of needles to form stitches connecting said concentric tubes into a plurality of garment configurations, each configuration having a first surface on one of said tubes and a second surface on a juxtaposed portion of the other tube.

10. The process of claim 9 wherein two feeds are used per course with said dial needles and two feeds are used per course with said cylinder needles.

11. The process of claim 9 wherein even knitting dial needles are at a different knitting butt height than odd knitting dial needles to produce a non-ladder knit.

12. The process of claim 9 wherein said two concentric tubes are formed of different material.

13. The knitted structure of claim 1 wherein said two concentric tubes are of different material.

14. The knitted structure of claim 1 wherein said garment configurations formed by said interconnected knitting is a nether garment.

15. The knitted structure of claim 1 wherein said garment configuration formed by said interconnected knitting is a shirt with arms.

16. The knitted structure of claim 1 wherein said garment configuration formed by said interconnected knitting is a dress.

* * * * *

UNITED STATES PATENT OFFICE

CERTIFICATE OF CORRECTION

PATENT NO. 3,985,003

DATED October 12, 1976

INVENTOR(S) : Alfred J. Reed

It is certified that error appears in the above-identified patent and that said Letters Patent are hereby corrected as shown below:

Column 4, lines 54-59 should appear as follows:

| | Non-Interconnect | | Interconnect | |
|---|---|---|---|---|
| | Dial | Cylinder | Dial | Cylinder |
| Feed 1 | Short | ■ | Short | X |
| Feed 2 | | | | |
| Feed 3 | Long | □ | Long | O |
| Feed 4 | | | | |

Column 5, lines 30-35 should appear as follows:

| | Non-Interconnect | | Interconnect | |
|---|---|---|---|---|
| | Dial | Cylinder | Dial | Cylinder |
| Feed 1 | Short | ■ | Short | X |
| Feed 2 | | | | X |
| Feed 3 | Long | □ | Long | O |
| Feed 4 | | | | O |

Signed and Sealed this

Third Day of May 1977

[SEAL]

*Attest:*

RUTH C. MASON
*Attesting Officer*

C. MARSHALL DANN
*Commissioner of Patents and Trademarks*